United States Patent [19]

Landsberger

[11] 4,031,575

[45] June 28, 1977

[54] ADJUSTABLY MOUNTED SUPERIMPOSABLE TOILET SEAT

[76] Inventor: Kurt Landsberger, 103 Harrison St., Verona, N.J. 07044

[22] Filed: May 24, 1976

[21] Appl. No.: 689,130

[52] U.S. Cl. ..... 4/239

[51] Int. Cl.[2] ..... A47K 13/06; A47K 13/28

[58] Field of Search ..... 4/235, 239

[56] References Cited

UNITED STATES PATENTS 1,085,468 1/1914 Nixon ..... 4/239

3,392,411 7/1968 Hansen ..... 4/239

FOREIGN PATENTS OR APPLICATIONS 1,166,849 6/1958 France ..... 4/239

*Primary Examiner*—Robert I. Smith

*Attorney, Agent, or Firm*—Anthony F. Cuoco

[57] ABSTRACT

A toilet seat for use by invalids, infirm persons or the like is disclosed which is superimposable upon a conventional toilet seat. The superimposable toilet seat is adjustably mounted on rails, and which rails provide support and assistance to the user of the seat.

7 Claims, 5 Drawing Figures

ADJUSTABLY MOUNTED SUPERIMPOSABLE TOILET SEAT

BACKGROUND OF THE INVENTION

1. Field of the Invention

This invention relates generally to superimposable toilet seats and particularly to adjustably mounted superimposable toilet seats. More particularly this invention relates to superimposable toilet seats of the type described which are mounted to provide support and assistance to the user.

2. Description of the Prior Art

Superimposable toilet seats for use by invalids or infirm persons are well known in the art. A typical seat of this type is described in U.S. Pat. No. D.237,887 issued on Dec. 2, 1975 to Kurt Landsberger, inventor of the present invention.

Prior to the present invention it has been necessary to superimpose these seats on a conventional toilet seat, whereupon they are retained thereon by hooks, friction surfaces or other like means. While toilet seats of this type are satisfactory for many people, there are those whose degree of infirmity requires support and assistance when using the seat. Additionally, for safety purposes, it is desirable that the superimposable toilet seat be free standing and adjustable relative to the height of the conventional toilet seat above the ground. The present invention satisfies these purposes by providing a superimposable toilet seat mounted on a pair of rails which support and assist the user when using the seat, and provide the aforenoted free-standing and adjustable capabilities as well.

SUMMARY OF THE INVENTION

This invention contemplates an adjustably mounted superimposable toilet seat including user support and assistance means. The seat has outwardly extending corner portions each of which carries a tubular member. A pair of rails are provided, each of which has a pair of parallel longitudinally extending legs connected by a laterally extending top member. The parallel legs of the rails are slidingly mounted in corresponding front and rear corner portion tubular members, whereby the toilet seat is adjustably mounted on a rail on each side thereof. The seat is longitudinally slideable along the rails so as to be adjustable relative to the height of a conventional toilet seat with which it is used and brackets are arranged in association with the rails to retain the superimposable seat in a predetermined adjusted position as is desirable for safety and storage purposes. The connecting top members of the rails may carry padding or the like so as to provide a safety support feature for the user, and the seat and rails may be easily disassembled to enhance portability and/or storage.

One object of this invention is to provide a superimposable toilet seat adjustably mounted on rails, and which rails provide support and assistance to the user of the seat.

Another object of this invention is to adjustably mount the superimposable toilet seat so that it may be used with a conventional toilet seat irrespective of the height of said seat.

Another object of this invention is to provide a superimposable toilet seat integral with mounting rails, and which rails serve the further purpose of supporting and assisting the user of the seat.

Another object of this invention is to provide a superimposable toilet seat and rail combination of the type described which is easily disassembled so as to be rendered portable and easily storable.

The aforegoing and other objects and advantages of the invention will appear more fully hereinafter from a consideration of the deatiled description which follows taken together with the accompanying drawing wherein a single and preferred embodiment of the invention is illustrated by way of example. It is to be expressly understood however that the drawing is for illustration purposes only and is not to be construed as defining the limits of the invention.

DESCRIPTION OF THE INVENTION

Figure 3:
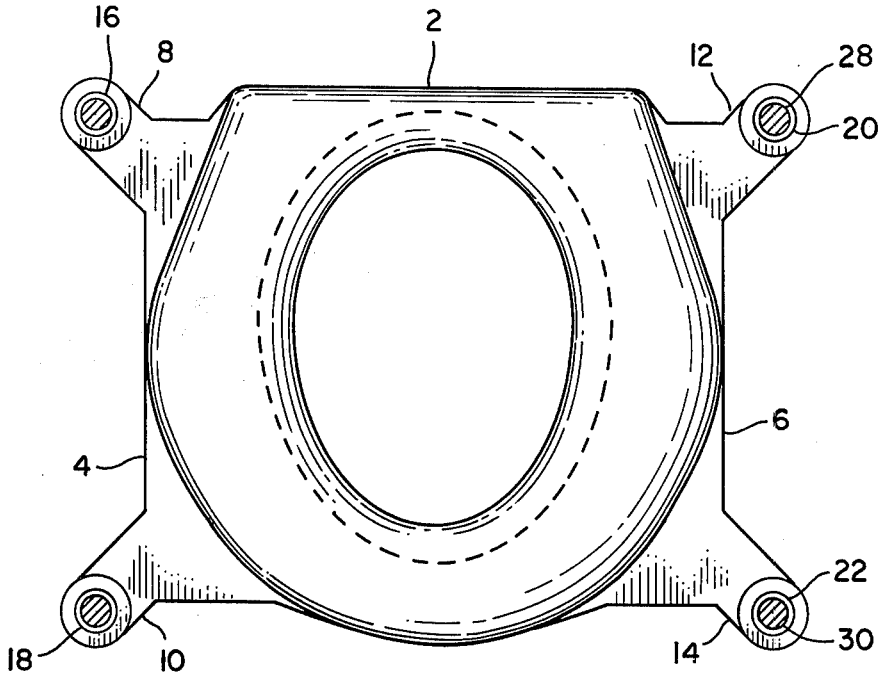
FIG. 3 is a partially sectioned top view taken along the line 3—3 in FIG. 2.

With reference to the drawing and with particular reference first to FIG. 3, there is shown a superimposable toilet seat designated generally by the numeral 2. Superimposable toilet seat 2 may be disposed on top of a conventional toilet seat so as to be usable by invalids or those suffering from infirmities. Such superimposable toilet seats are well known in the art and may be, for purposes of illustration, such as described in the aforenoted U.S. Pat. No. D.237,887.

Figure 1:
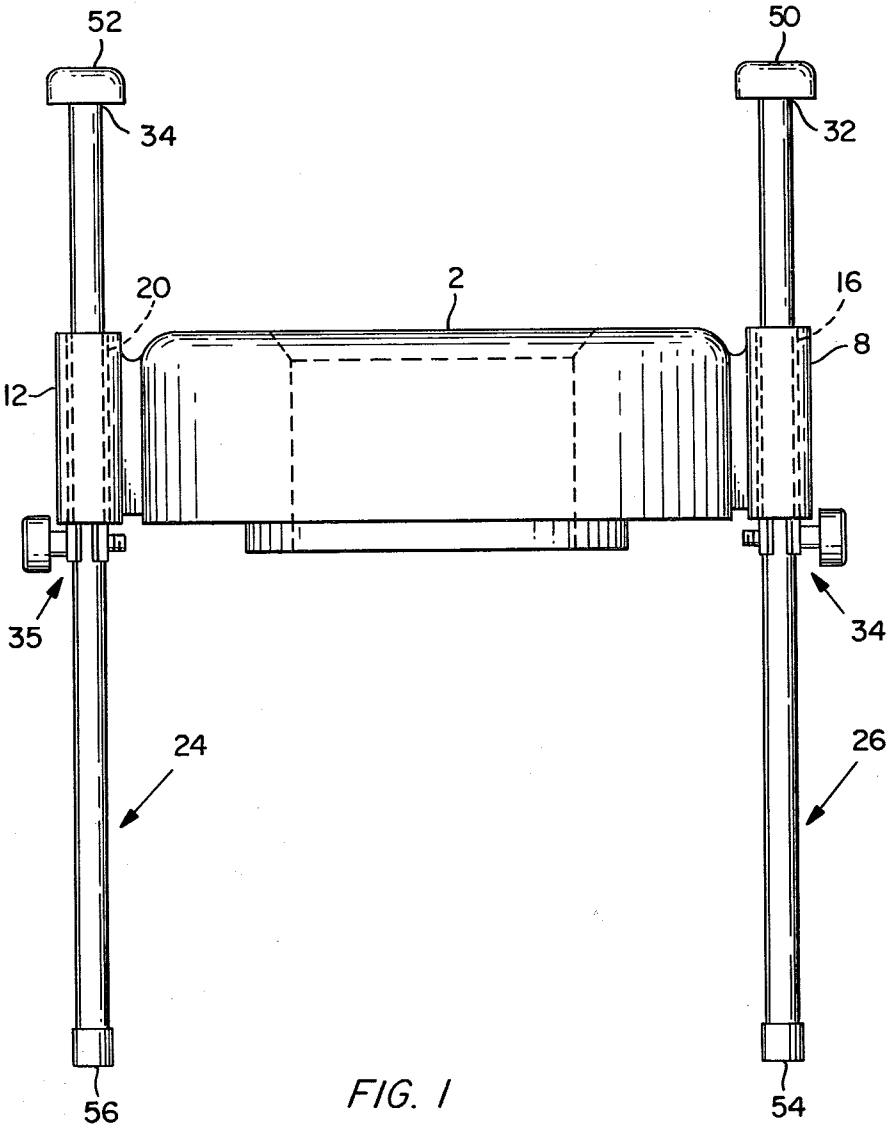
FIG. 1 is a front view of an adjustably mounted superimposable toilet seat according to the invention.

Supported on opposite sides of toilet seat 2 and from the front to the rear of the seat are frame members 4 and 6. Frame member 4 has front and rear extending corners 8 and 10, respectively, while frame member 6 has front and rear extending corners 12 and 14, respectively. Corners 8, 10, 12 and 14 are longitudinally extending cylindrical hollow members such as illustrated in FIG. 1, wherein front corners 8 and 12 are shown. Hollow cylindrical corner members 8, 10, 12 and 14 may have inserted therein bushings 16, 18, 20 and 22 for purposes which will be hereinafter further described with reference to FIGS. 1 and 2.

Figure 2:
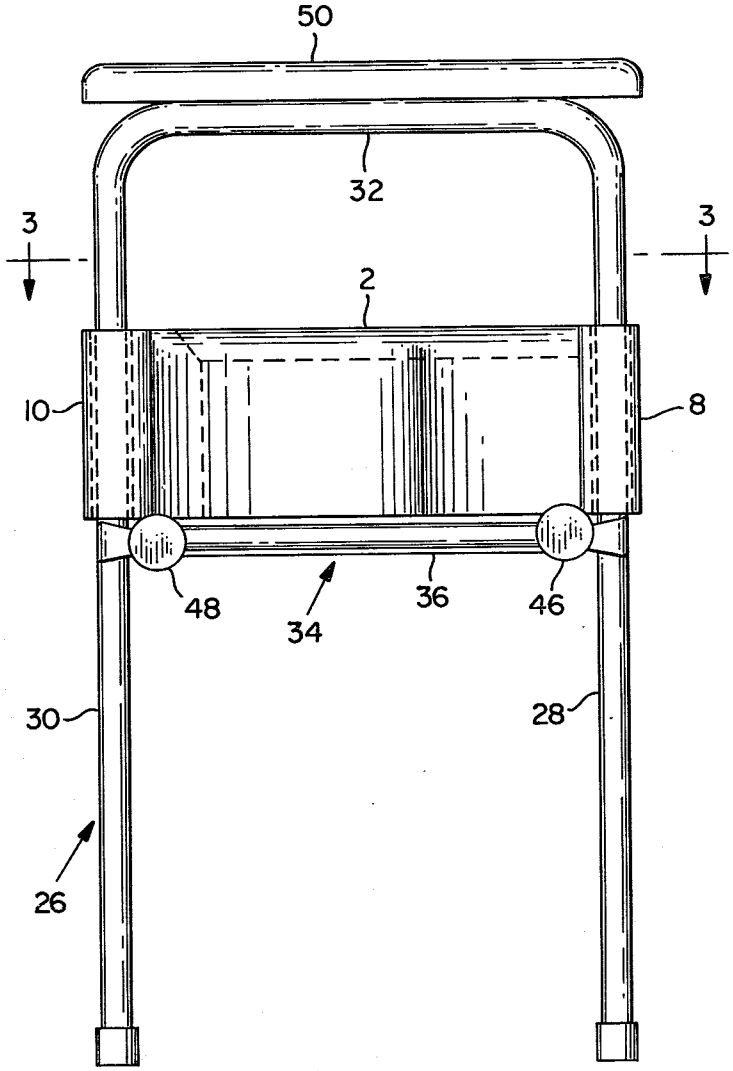
FIG. 2 is a right side view of the invention relative to FIG. 1, with the left side view being substantially the same.

As best shown in FIGS. 1 and 2, superimposable toilet seat 2 is mounted on a pair of vertically disposed rails 24 and 26. In FIG. 2, wherein rail 26 is best shown, the rail is illustrated as being generally of an inverted U-shape having a pair of legs 28 and 30 and a connecting member 32. In the preferred embodiment of the invention legs 28 and 30 and connecting member 32 are a single unitary bar or tubular member which is bent or otherwise formed into the shape as shown. It will be understood that rail 24 is structurally the same as rail 26.

As best shown in FIG. 1, seat 2 is mounted on rails 24 and 26 wherein the legs of the rails extend through the hollow cylindrical corners. Thus, with reference to FIG. 2, leg 28 is mounted in front corner 8 and leg 30 is mounted in rear corner 10. The corresponding legs of frame member 24 are likewise mounted in corners 12 and 14, respectively. In this connection it will be understood that bushings 16, 18, 20 and 22 may be of a suitable self lubricating tetrofluoroethylene or other like material to provide a sliding fit between the hollow cylindrical corners and the rail legs mounted therein so that the seat is easily adjustable longitudinally along the legs with little effort as is desired for those who are invalid or infirm and for whose use the device of the invention is intended.

Figure 5:
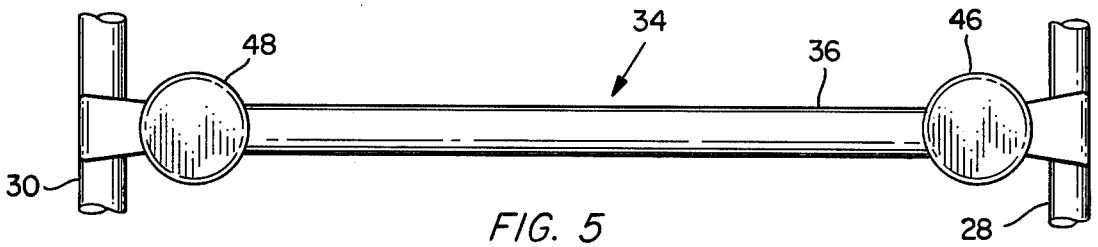
FIG. 5 is a side view of the bracket, the top view of which is shown in FIG. 4.
Figure 4:
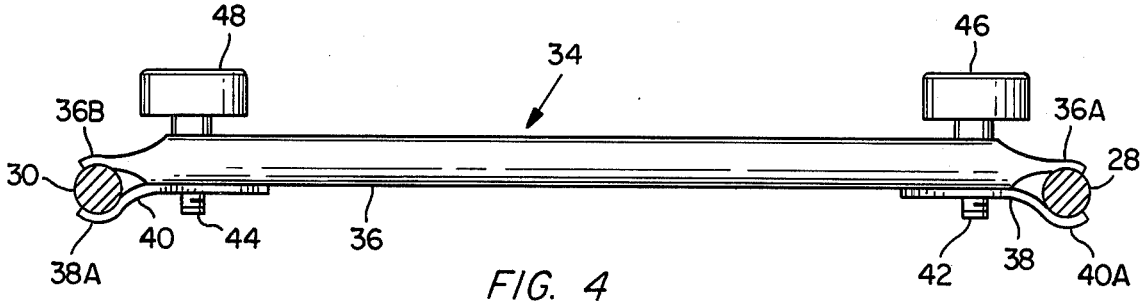
FIG. 4 is a partially sectioned top view of a bracket used for retaining the toilet seat of the invention at a predetermined adjusted position.

With reference now to FIGS. 4 and 5, each of the rails 24 and 26 includes a laterally extending adjustable bracket such as bracket 34 and 35 shown in FIG. 1, and which bracket 34 is shown in substantial detail in FIGS. 4 and 5. Thus, bracket 34 includes a bar 36 which extends the lateral distance between the parallel legs of the rail as seen in FIG. 2, wherein bracket 34 is shown in association with legs 28 and 30 of rail 26 for purposes of illustration. A pair of clamp members 38 and 40 have substantially C-shaped ends 38A and 40A which cooperate with corresponding C-shaped ends 36A and 36B of bar 36 to surround rail legs 28 and 30, respectively, as shown in FIG. 4. Clamps 38 and 40 are engaged through threaded members 42 and 44, respectively, with bar 36 for relative tightening and loosening of the bar through hand knobs 46 and 48. In this connection it is to be noted that knobs 46 and 48 are large enough so to be easily grasped by the invalid or infirm, and are easily rotatable so as to tighten or loosen the clamps and bar as will now be understood by those skilled in the art.

When seat 2 is in a storage position; that is when not in use, brackets 34 and 35 may be longitudinally adjusted to retain seat 2 below the conventional toilet seat level so as to prevent accidental and injurious usage of seat 2 as otherwise might be likely to occur. In this case, when seat 2 is adjusted along rails 24 and 26 to its desired storage height, knobs 36 and 38 are hand turned so as to tighten the aforenoted brackets and clamps about the respective rail legs.

When it is desired to use the seat, i.e., superimpose it upon a conventional toilet seat, the hand knobs are turned to loosen the brackets and clamps. The seat and brackets are adjustable upward along the legs of the rails whereupon the superimposable seat is raised to the level of the conventional seat. The hand knobs are then tightened to secure the clamps and brackets about the rail legs. Seat 2 is above the conventional toilet seat and allowed to slide down the rails to rest thereon for use as is desired.

With reference now particularly to FIGS. 1 and 2, the connecting members such as 32 and 34 may carry padded surfaces 50 and 52 suitably secured thereto. These padded surfaces may be used to support the arms or hands or other members of the upper torso of the user so as to conveniently assist the user when using the device of the invention.

To prevent slippage or the like the bottom portions of each of the legs of the rails carry feet members such as 54 and 56 (FIG. 1) of rubber or some other suitable non-slipping material as will be understood by those skilled in the art.

It will now be understood from the aforegoing description of the invention that an integral superimposable toilet seat and rail assembly has been disclosed such as may be used by invalids or infirm persons or the like. The rails adjustably mount the seat for use and for storage, and provide assistance and support for the user as well. The seat and rails may be easily aligned with the conventional toilet seat when use is desired, and moved away therefrom when said used has terminated.

The superimposable toilet seat disclosed is easily adjustable so as to require little strength and thereby renders the user independent of other persons as may be to his best interests. An important feature of the invention is that it is easily disassembled for transportation or storage purposes or the like. Thus, the seat may be easily removed from the rails and reassembled thereon simply by loosening or tightening the brackets and clamps as will be understood from the aforegoing description of the invention.

The superimposable toilet seat as heretofore described may be of a unitary molded plastic construction. That is, seat 2 with side members 4 and 6 including corners 8, 10, 12 and 14 may be of a suitable molded plastic or like material so as to form a unitary member. On the other hand, side members 4 and 6 may be of separate construction and may be affixed to toilet seat 2, the same being a manufacturing choice as will now be discerned.

Rails 24 and 26 may be plastic or metallic (as shown) tubular or bar members bent or otherwise formed into the inverted U-shape as best shown in FIG. 2. Bushings 16, 18, 22 and 24 may be inserted into cylindrical members 8, 10, 12 and 14 in press fit relation so as to provide a sliding surface for the rail legs as aforenoted.

Although only one embodiment of the invention has been illustrated and described in detail various changes in the form and relative arrangement of the parts which will now appear obvious to those skilled in the art may be made without departing from the spirit and scope of the invention.

What is claimed is:

1. An adjustably mounted toilet seat of the type superimposable on a conventional toilet seat, comprising:

a superimposable toilet seat;

a pair of frame members, each of which extends along an opposite side of the superimposable toilet seat;

each of the frame members carrying front and rear corner members;

a pair of vertically disposed rails, each of which has a pair of parallel legs, one of the legs of each of the rails being slidably supported by one of the front and rear corner members of a corresponding frame member and the other leg being slidably supported by the other of the front and rear corner members, the superimposable toilet seat being thereupon longitudinally adjustable along the rails; and means associated with the rail legs for retaining the superimposable toilet seat in a predetermined longitudinally adjusted position relative to the height of the conventional toilet seat and including a pair of bars, each of which extends between the legs of a corresponding rail for supporting the superimposable seat, a pair of clamps associated with each of the bars, each of the clamps cooperating with a bar end for clamping the end to a corresponding rail leg, means arranged with the clamps and bar ends and loosened for longitudinally displacing the bars along the legs to the adjusted position relative to the height of the conventional toilet seat, and said means tightened for retaining the bars and superimposable toilet seat supported thereby in the adjusted position.

2. An adjustably mounted toilet seat as described by claim 1, wherein:

the pair of parallel legs of the vertically disposed rails are connected by horizontally disposed members; and the horizontally disposed members carry padding for supporting the upper torso of a user of the adjustably mounted seat.

3. An adjustably mounted toilet seat as described by claim 1, wherein the means arranged with the clamps and bar ends includes:

manually operable threaded members for engaging the clamps and bar ends, said threaded members being loosened for longitudinally displacing the bars along the legs to the adjusted position and tightened for retaining the bars and superimposable toilet seat supported thereby in the adjusted position.

4. An adjustably mounted toilet seat as described by claim 2, wherein:

the vertically disposed rails are unitary members of an inverted U-shape to provide the pairs of parallel legs and the horizontally disposed connecting members.

5. An adjustably mounted toilet seat of the type superimposable on a conventional toilet seat, comprising:

a superimposable toilet seat;

a pair of frame members, each of which extend along an opposite side of the superimposable toilet seat;

each of the frame members carrying front and rear hollow cylindrical corner members;

a pair of vertically disposed rails, each of which has a pair of parallel legs, one of the parallel legs of each of the rails being slidably supported by the front hollow cylindrical corner member of a corresponding frame member and the other parallel leg being slidably supported by the rear hollow cylindrical corner member of the frame member, the superimposable toilet seat being thereupon longitudinally adjustable along the rails; and means associated with the rail legs for retaining the superimposable toilet seat in a predetermined longitudinally adjusted position relative to the height of the conventional toilet seat.

6. An adjustably mounted toilet seat as described by claim 5, wherein:

the pair of parallel legs of the vertically disposed rails are connected by horizontally disposed members; and the horizontally disposed members carry padding for supporting the upper torso of a user of the adjustably mounted seat.

7. An adjustably mounted toilet seat as described by claim 6, wherein:

the vertically disposed rails are unitary members of an inverted U-shape to provide the pairs of parallel legs and the horizontally disposed connecting members.

* * * * *